US008418454B2

(12) United States Patent
Samarin

(10) Patent No.: US 8,418,454 B2
(45) Date of Patent: Apr. 16, 2013

(54) THERMAL ENGINE

(75) Inventor: Alexander Samarin, Moscow (RU)

(73) Assignee: Mona Intellectual Property Establishment, Vaduz (LI)

( * ) Notice: Subject to any disclaimer, the term of this patent is extended or adjusted under 35 U.S.C. 154(b) by 366 days.

(21) Appl. No.: 12/813,397

(22) Filed: Jun. 10, 2010

(65) Prior Publication Data

US 2010/0313559 A1 Dec. 16, 2010

(30) Foreign Application Priority Data

Jun. 11, 2009 (CH) ..... 0906/09
Oct. 21, 2009 (CH) ..... 1608/09

(51) Int. Cl.
*F01B 29/10* (2006.01)
*F02G 1/04* (2006.01)

(52) U.S. Cl.
USPC ..... 60/525; 60/517

(58) Field of Classification Search ..... 60/516, 60/517, 520, 525
See application file for complete search history.

(56) References Cited

U.S. PATENT DOCUMENTS

| | | | | |
|---|---|---|---|---|
| 3,183,662 | A * | 5/1965 | Korsgren, Sr. | 60/518 |
| 3,751,904 | A * | 8/1973 | Rydberg | 60/525 |
| 4,282,716 | A * | 8/1981 | Momose et al. | 62/6 |
| 5,394,700 | A * | 3/1995 | Steele | 60/525 |
| 6,684,637 | B2 * | 2/2004 | Beale | 60/526 |
| 2009/0056331 | A1 * | 3/2009 | Zhao et al. | 60/524 |
| 2010/0205956 | A1 * | 8/2010 | Clucas et al. | 60/524 |
| 2011/0041492 | A1 * | 2/2011 | Maguire | 60/520 |

* cited by examiner

*Primary Examiner* — Thomas Denion
*Assistant Examiner* — Ngoc T Nguyen
(74) *Attorney, Agent, or Firm* — Speckman Law Group PLLC; Janet Sleath

(57) ABSTRACT

A thermal engine is described, which has two pairs of chambers, comprising a first and a second heat transmission chamber and a first and second working chamber which are connected alternately via a first and second cooling device and a first and second heat exchanger, so that a shared total interior is formed, in which a working medium is situated. Linearly movable first and second heat transmission pistons and first and second working pistons are mounted inside the chambers. The particular relative aligned arrangement of the chambers and the special development of the piston heads of the heat transmission pistons lead to an increased efficiency of the thermal engine being able to be achieved.

10 Claims, 13 Drawing Sheets

THERMAL ENGINE

REFERENCE TO RELATED APPLICATIONS

This application claims priority to Swiss Patent Application Nos. CH-00906/09 filed Jun. 11, 2009 and CH-01608/09 filed Oct. 21, 2009.

TECHNICAL FIELD

The present invention describes a heat transmission piston for a thermal engine with a first working piston, and a thermal engine with a driven flywheel or a crankshaft with a closed total interior, which is able to be filled with a working medium and is able to be closed in a pressure-tight manner, comprising at least a first working chamber with a linearly movable first working piston, at least a first heat transmission chamber with a linearly movable first heat transmission piston, which has a piston head and a piston pin, a first heat exchanger connected with the first working chamber and the first heat transmission chamber, and a first cooling device, wherein the first working piston and the first heat transmission piston are coupled mechanically with each other.

BACKGROUND

Thermal engines, for example Stirling engines, have been known for a long time and offer a possibility of converting thermal energy into mechanical work, wherein a very high degree of efficiency is possible, and with long maintenance-free operating times owing to the type of construction.

Although such thermal engines which are known hitherto have advantages such as the lack of restriction to a particular heat source, these are not yet used commercially on a larger scale because the efficiency of the thermal engines is still very far removed from the efficiency of internal combustion engines.

The document EP0850353 discloses thermal engines in the form of a Stirling engine, wherein the working medium runs through a circulation process in which thermal energy is partially converted into mechanical work.

A plurality of chambers in cylinder form and pistons are provided, which are mechanically coupled with each other, wherein the pistons move substantially in phase opposition with respect to each other during operation. Through an alternating heating, by means of heat exchangers, and cooling, by means of cooling devices, of a working medium within the chambers, pistons are able to be moved to and fro linearly in a corresponding manner. The linear movement of the pistons is converted by a mechanical coupling by means of a wobble plate into a rotary movement. The wobble plate drives a drive shaft which is able to be connected mechanically with a load. To increase the efficiency, various steps were taken, for example the sealing of the pistons was improved. By a suitable choice of high temperature materials for the chambers and pistons, the temperature difference between the hot side of the heat exchangers and the cold side of the cooling devices was able to be increased without danger, whereby the resulting mechanical work was increased.

The improvement to the operation of the thermal engine of EP0850353 was achieved by means to set the piston stroke and the wobble disc angle. These means are embodied electrically and lead to the thermal engine having to be equipped with a motor and further components. Such thermal engines are therefore more complex and embodied with a plurality of components, whereby they are more complicated to operate and are more liable to error.

Hitherto, to optimize the heat conduction or heat transmission to the working medium, the working medium is guided through a plurality of thin small tubes with a large overall surface outside the chambers, with the thermal energy being transferred. In order to achieve higher outputs, the operating pressure had to be increased accordingly, from which a mechanical stressing of the plurality of small tubes results.

SUMMARY

The present invention provides a novel possibility for exchanging thermal energy with a small dead volume. Through the reduced use of a plurality of thin small tubes for the heat exchange, the resulting moments onto the pistons are smaller than in motors of the prior art.

The present invention solves the problem of providing a mechanical thermal engine in the manner of a Stirling engine, which allows a usage of air as working medium, wherein a sufficiently high efficiency is able to be achieved, with additional electrical controls and consumers being dispensed with.

This problem and in addition the improvement to the exchange of thermal energy taking place on the heat conduction without increasing the so-called dead volume, wherein the working medium is not cooled unnecessarily before the heating process, is solved by the thermal engine according to the invention.

BRIEF DESCRIPTION OF THE DRAWINGS

A preferred example embodiment of the subject matter of the invention is described below in connection with the attached drawings, wherein.

DETAILED DESCRIPTION

Figure 1:
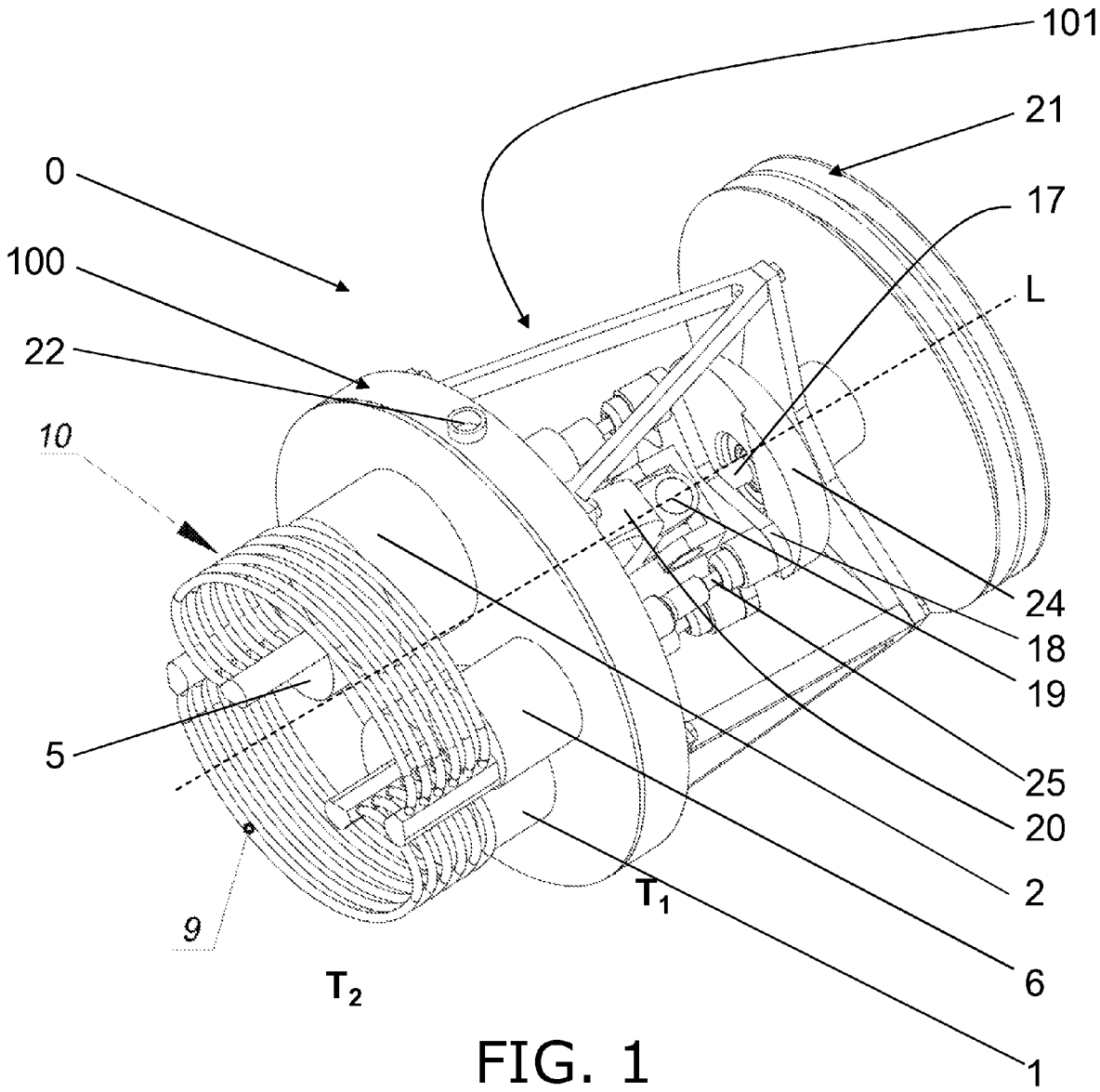
FIG. 1 shows a perspective view of a thermal engine with a first and a second heat exchanger in the foreground, whilst
Figure 2:
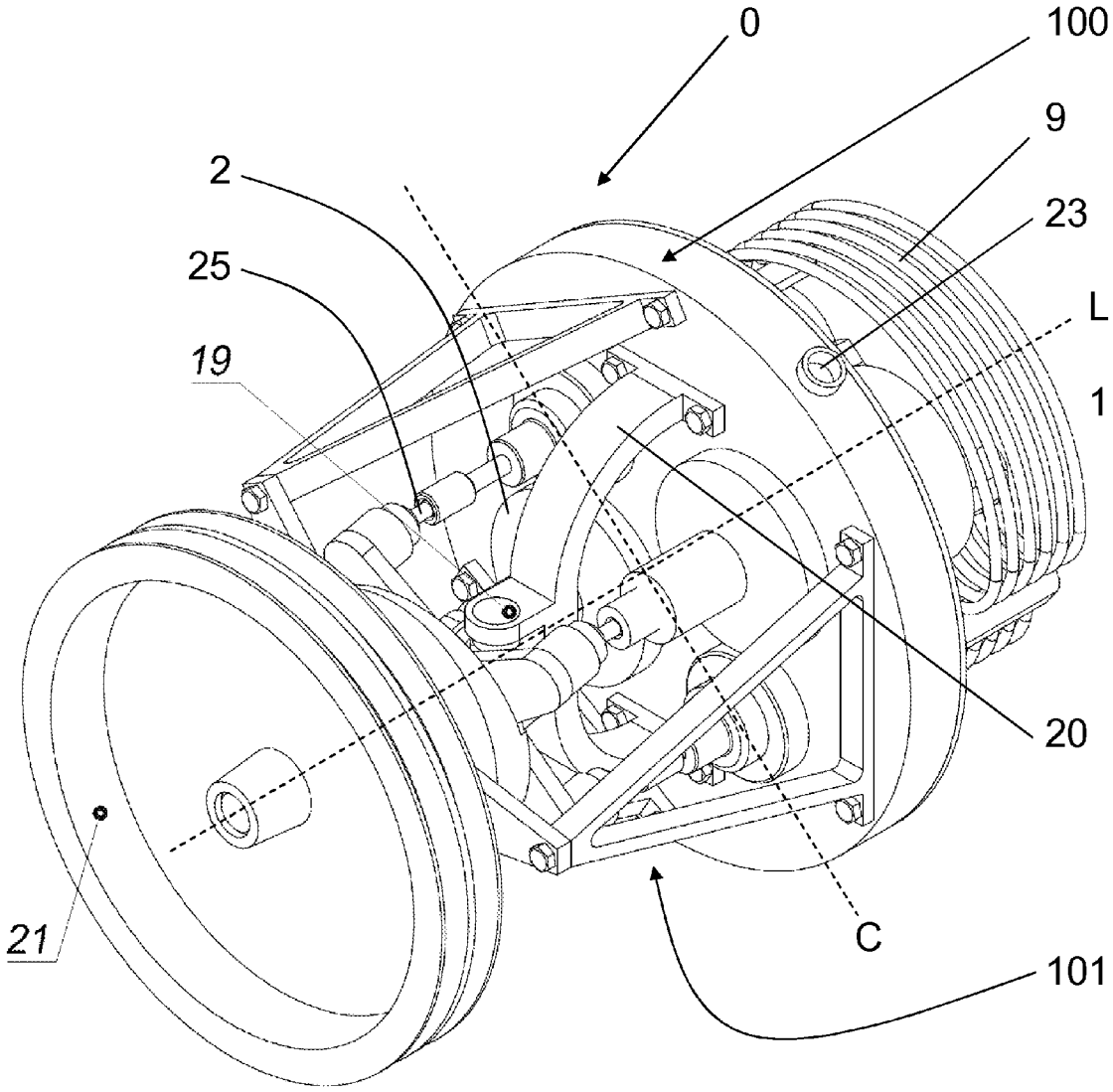
FIG. 2 shows a perspective view of a thermal engine from the flywheel side.

A preferred embodiment of a thermal engine 0 according to the invention, in the form of a Stirling engine 0, which drives a flywheel 21 by the use of a thermodynamic cyclic process is shown in the attached figures and is described in detail below. The flywheel 21 can be connected, for example, with a device for using the mechanical initial energy or with an electric generator for conversion into electrical energy.

A first heat transmission chamber 1, a second heat transmission chamber 2, a first working chamber 5 and a second working chamber 6 are arranged on a base flange 100. The chambers 1, 2, 5, 6, shaped in particular in a hollow cylindrical shape, respectively form an inner displacement space. The first heat transmission chamber 1 is connected outside the base flange 100 via a first heat exchanger 9 with the first working chamber 5. The second heat transmission chamber 2 is connected outside the base flange 100 via a second heat exchanger 10 with the second working chamber 6.

Figure 6:
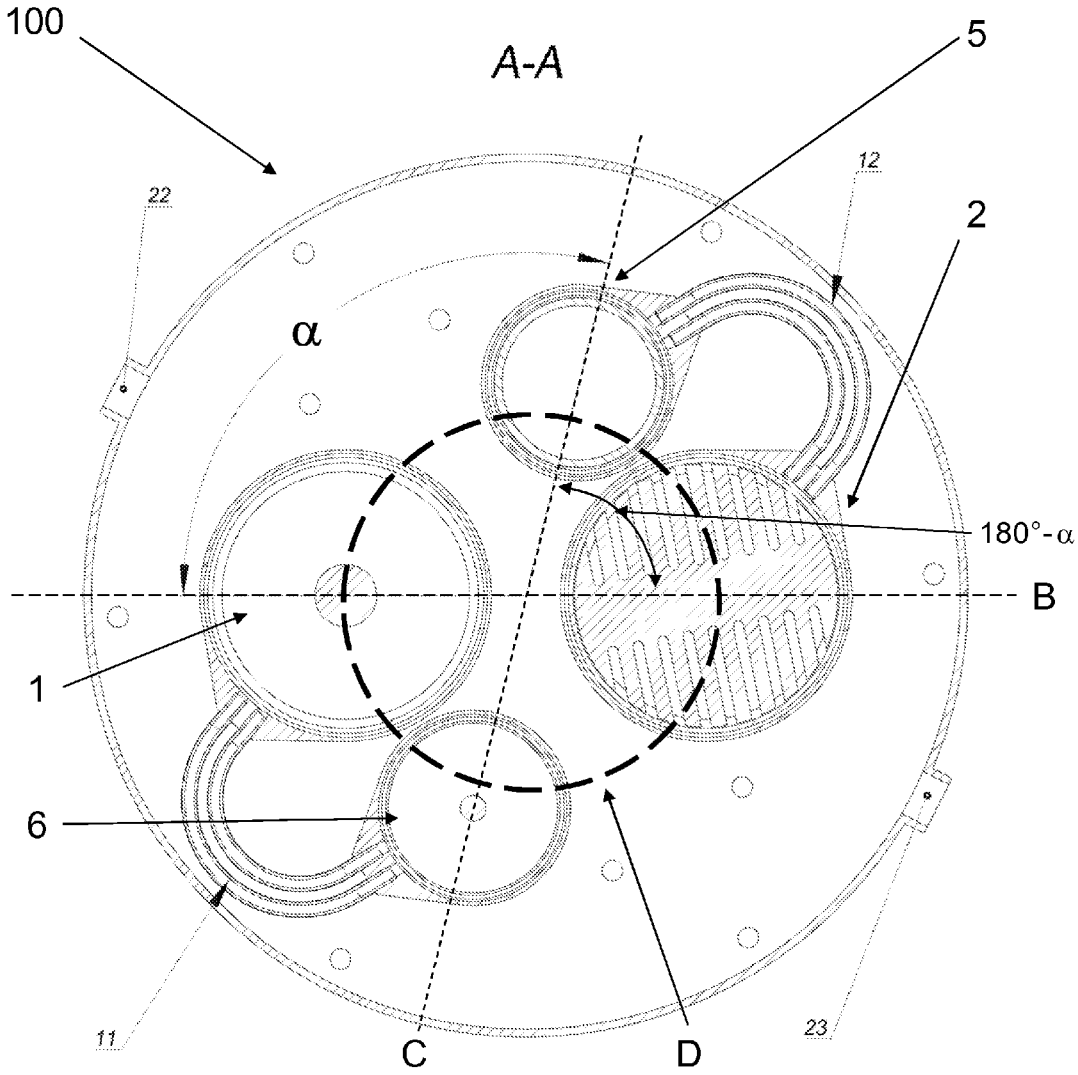
FIG. 6 shows a cross-section through a heat transmission chamber according to line A-A of FIG. 4.

A first cooling device 11 and a second cooling device 12 run inside the base flange 100 (illustrated in FIG. 6). Whilst the first heat transmission chamber 1 is connected with the second working chamber 6 via the first cooling device 11, the second heat transmission chamber 2 is connected with the first working chamber 5 via the second cooling device 12. The heat transmission chambers 1, 2, the heat exchangers 9, 10, the working chambers 5, 6 and the cooling devices 11, 12 form a cohesive, closed and gas-tight total interior, which is filled with a working medium.

By the alternating connection of the heat transmission chambers 1, 2 via heat exchangers 9, 10 and cooling devices 11, 12, a closed total interior is produced. The thermal engine 0 according to the invention can be used with the air as the working medium, but also with pure nitrogen or oxygen as the working medium.

The heat exchangers 9, 10 outside the base flange 100 and the cooling devices 11, 12 are embodied in the form of a plurality of small tubes. Whilst the cooling devices 11, 12 inside the base flange 100 are in thermal contact with a coolant, the heat exchangers 9, 10 are in thermal contact with an external heat source. During the operation of the thermal engine 0, the heat exchangers 9, 10 are connected with a heat source, so that the working medium situated inside the heat exchangers 9, 10 is heated up. The thermal energy which is supplied from the exterior by the heat source heats the side of the thermal engine 0 on which the heat exchangers 9, 10 are situated, to a temperature $T_2>T_1$. The type of heat source does not play any part in the thermal engine according to the invention and is able to be selected according to the place of use of the thermal engine and the accessibility.

The cooling devices 11, 12 arranged inside the base flange 100 are cooled by means of a coolant to the temperature $T_1$, so that the working medium circulating inside the cooling devices 11, 12 is cooled down accordingly. The coolant, for example water, is able to be introduced by a coolant inlet 22 and a coolant outlet 23 into the base flange 100 and is able to be exchanged accordingly.

A guide link 101 is fastened on the side of the base flange 100 lying opposite the heat exchangers 9, 10 along the longitudinal axis L. The flywheel 21 is rotatably mounted on a coupling mechanism which is fastened inside the guide link 101.

A joint fastening 20, which carries a cardan joint 19, is arranged so as to be detachably fastened on the guide link 101. A wobble plate 18 in the form of a cross is connected with the cardan joint 19, connected with the cardan joint 19 in a cooperating manner and is mounted so as to be able to be tilted on the cardan joint 19. On each of the four corners of the fixedly arranged wobble plate 18 in the form of a cross, a mounting is arranged respectively for a coupling rod 25. The coupling rod 25 is thereby pivotally movable with the wobble plate 18 on a first side.

The four coupling rods 25 are connected on the second side, facing the base flange 100, respectively with a first heat transmission piston 3, a second heat transmission piston 4, a first working piston 7 and a second working piston 8. The pistons 3, 4, 7, 8 respectively have a piston pin and a piston head, wherein the piston pin is cooperatively connected with a coupling rod 25 respectively. In operation of the thermal engine 0, the first heat transmission piston 3 moves linearly in the first heat transmission chamber 1 alternately in and out. The same applies to the second heat transmission piston 4 and the second heat transmission chamber 2 and the first and second working pistons 7, 8 into the corresponding first and second working chambers 5, 6.

Through the mechanical coupling of the individual pistons 3, 4, 7, 8 via the coupling rods 25 on the wobble plate 18, the pistons 3, 4, 7, 8 are moved in a fixed phase displacement into the chambers 1, 2, 5, 6 and out therefrom. Here, the first and second working pistons 7, 8 and the first and second heat transmission pistons 3, 4 are arranged respectively on opposite arms of the cross-shaped wobble plate 18. Each heat transmission piston 3, 4 is respectively arranged adjacent to the working pistons 7, 8 on the wobble plate 18.

The fixed wobble plate 18 is tilted differently by the movement. A shaft 17, fastened or formed on the wobble plate 18, is mounted in an eccentric bore 240 in an eccentric disc 24. The mounting of the shaft 17 takes place in a shaft bearing 241 inside the eccentric bore 240. The shaft 17 is deflected accordingly through the tilting movements of the wobble plate 18. The eccentric disc 24 is entrained by deflection of the shaft 17 and is set in rotation.

A drive shaft 103 formed on the eccentric disc 24 is guided by ball bearing through the guide link 101. The bearing of the drive shaft 103 in the guide link 101 takes place in a bearing 102, preferably a ball bearing 102. The flywheel 21, fastened on the drive shaft 103, is set in rotation accordingly by the piston movement. The deflection of the pistons 3, 4, 7, 8 therefore leads to a tilting movement of the wobble plate 18, which leads into a rotary movement of the drive shaft 103 and of the flywheel 21 fastened thereon by means of the eccentric disc 24.

Figure 4:
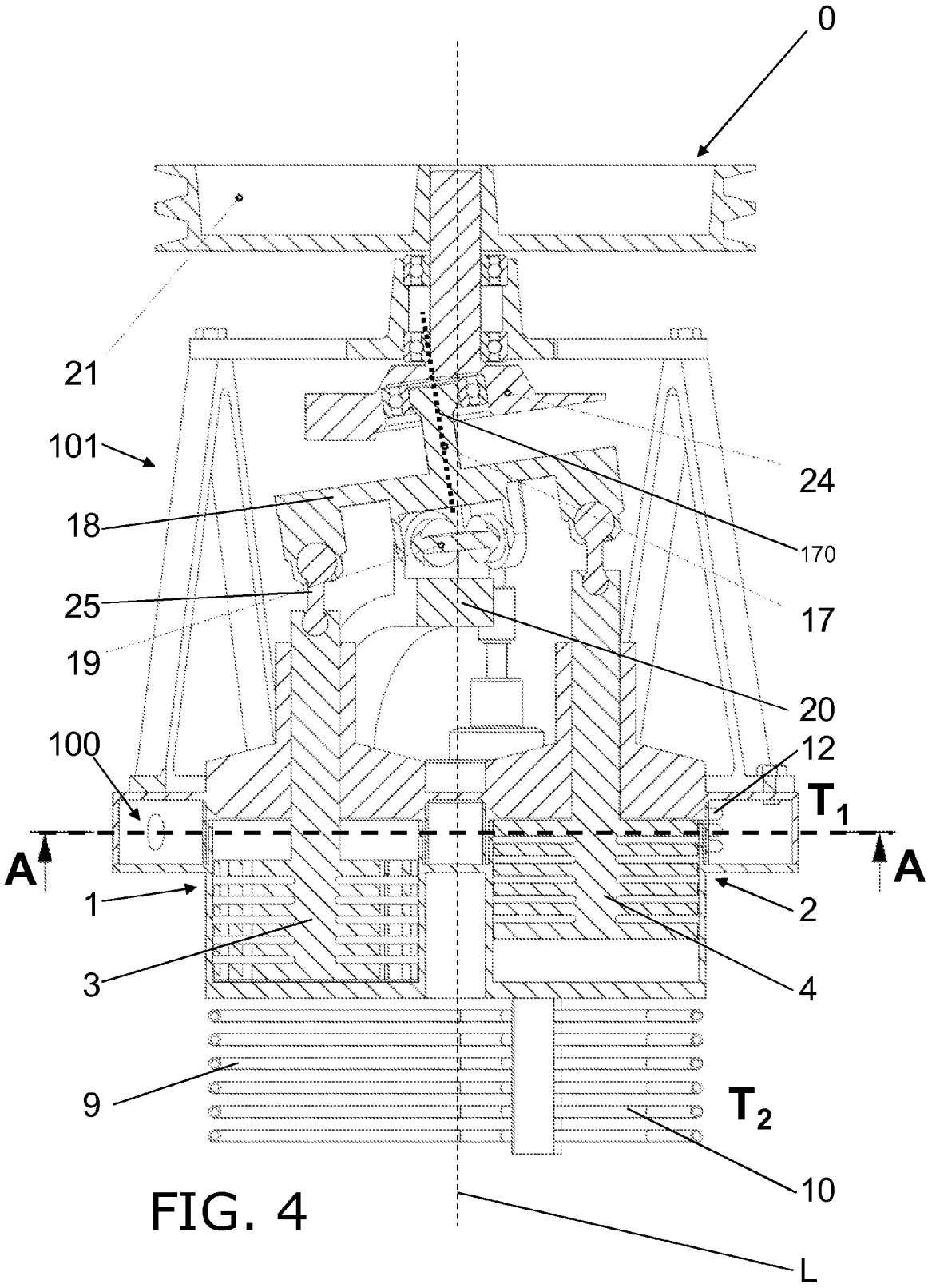
FIG. 4 shows a sectional view through the thermal engine along the central connecting line B through the first and second working chambers.

As indicated in FIG. 4, during the alternating stroke movements of the pistons 3, 4, 7, 8, the shaft longitudinal axis 170 makes a precession movement about the longitudinal axis L and hence about the cardan joint 19, wherein through the mounting of the shaft 17, the flywheel 21 is set in rotation. The kinetic energy of the flywheel 21 leads to a continuous operation, wherein the tilting movement and the precession movements of the shaft 17 is constantly maintained by the mechanically performed work, owing to the temperature difference, by means of the heat input of the first and second heat exchanger 9, 10.

The thermal engine 0 according to the invention has heat transmission chambers 1, 2 with distinctly greater lengths and/or diameters and hence greater displacement spaces than the corresponding first and second working chambers 5, 6. Accordingly, the diameters and cross-sectional areas of the piston heads of the heat transmission pistons 3, 4 are greater than the diameters and cross-sectional areas of the piston heads of the working pistons 7, 8.

Figure 3:
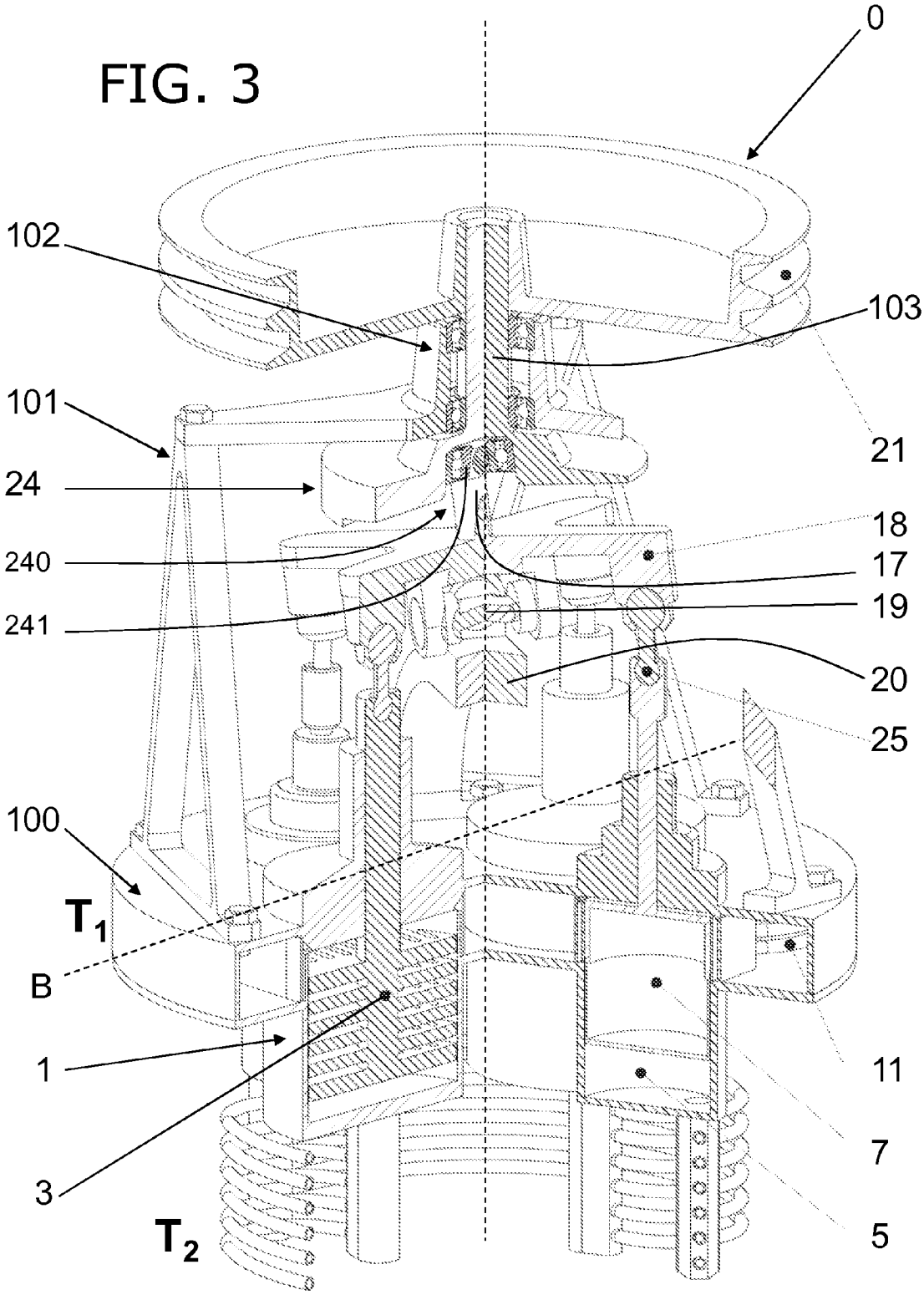
FIG. 3 shows a view, partially in longitudinal section, of a thermal engine with a section through a first heat transmission chamber and a first working chamber, whilst

In FIGS. 3 and 4, a special development of the heat transmission pistons 3, 4 becomes evident. The piston heads of the heat transmission pistons 3, 4 are respectively embodied in a segmented and slotted manner, whereby an increased surface results for the transmission of heat between working medium and piston head.

The piston head of the segmented and slotted first and second heat transmission pistons 3, 4 has a slightly smaller diameter than the inner width of the corresponding first and second heat transmission chambers 1, 2, so that a radial distance between heat transmission pistons 3, 4 and respective heat transmission chamber 1, 2 is guaranteed.

Figure 5:
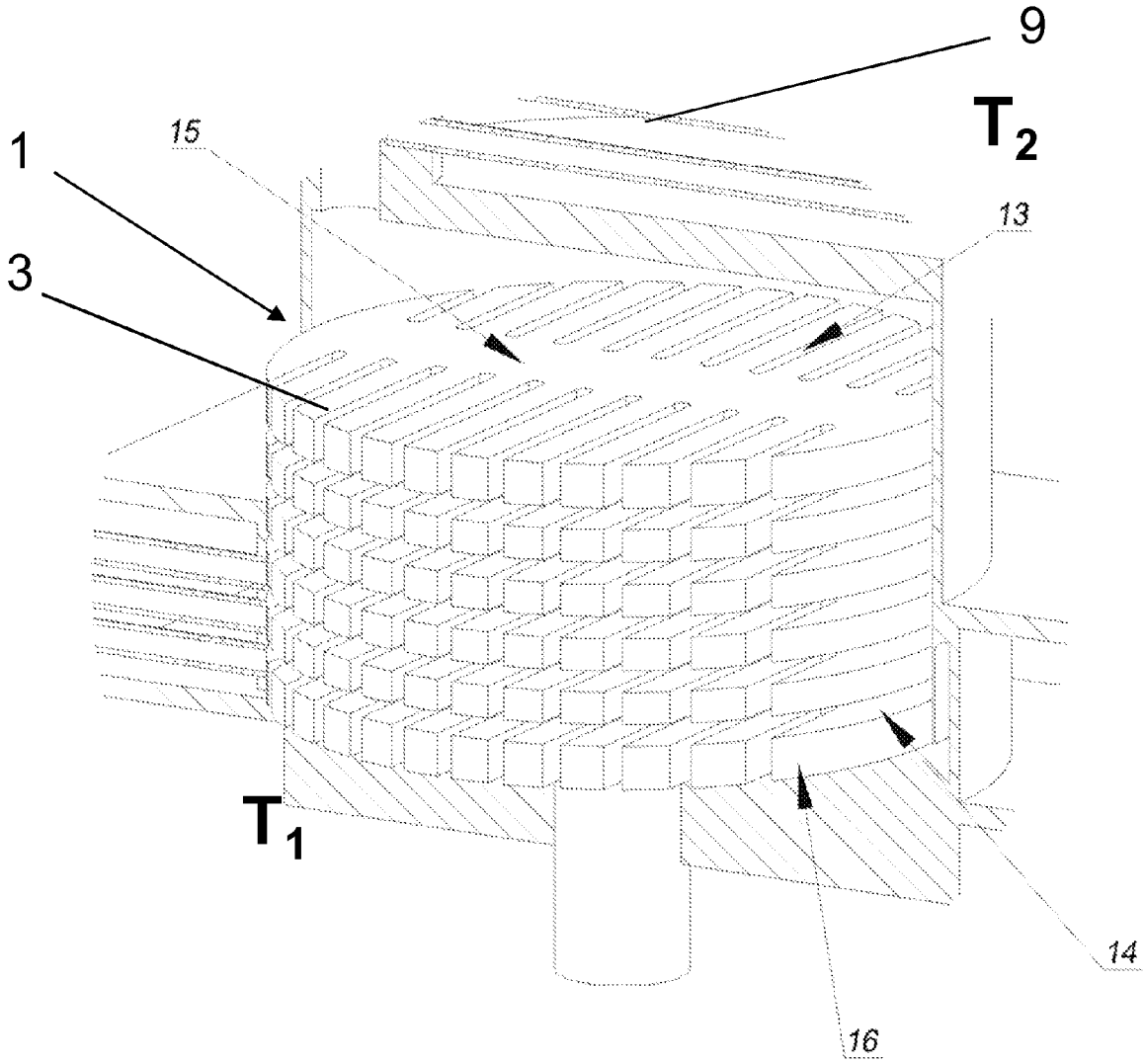
FIG. 5 shows a detailed perspective view, partially in section, of a first heat transmission piston in a first heat transmission chamber.

In FIG. 5, longitudinal slots 13 can be seen in the piston head of the first heat transmission piston 3 running approximately parallel to the piston pin of the first heat transmission piston 3. Working medium can pass through these longitudinal slots 13 from the direction of the first heat exchanger 9 from the heated part 15 of the first heat transmission chamber 1 in the direction of the piston pin. The working medium has a temperature $T_2$ in the region of the heated part 15. Transverse slots 14 make the heat conduction difficult through the segmented heat transmission piston 3 between the heated part 15 and the cooled part 16 of the first heat transmission chamber 1. By the development of the distinctly larger heat transmission chamber 1 compared with the first working chamber 5 and the heat transmission pistons 3, 4, embodied in a segmented manner, the resulting p-V diagram of the thermal engine 0 according to the invention differs greatly from the known Stirling p-V diagram.

Due to the arrangement described above, the pressure and temperature of the working medium scarcely alter during the movement of the first and second working pistons 5, 6. Due to the difference in size between the heat transmission chamber and the working chamber, the working medium does not pass through a conventionally known continuous thermodynamic cyclic process.

In FIG. 6 there is a central connecting line B, which runs along the centres of the first and second heat transmission chambers 1, 2 and through the longitudinal axis L. A further connecting line C runs along the centres of the first and second working chambers 5, 6 and crosses the longitudinal axis L. An angle $\alpha$ is spanned between the central connecting line B and the further connecting line C. Tests have shown that with the choice of the angle $\alpha$ in the range 90° to 140°, good results can be achieved. By different relative alignments of the chambers and correspondingly indirect fastening of the pistons on the wobble plate 18, thermal engines 0 according to the invention can be adapted to specific requirements. In addition to a space-saving construction, the arrangement of the pistons can be adjusted so as to be coordinated with achieving a maximum output or maximum efficiency.

The thermodynamic cycle of the thermal engine 0 is described below in four cycles by means of FIGS. 7*a* to 7*d*. Due to the alternating arrangement of the working pistons 7, 8 and heat transmission pistons 3, 4 described above, during operation of the thermal engine 0 either the working pistons 7, 8 or the heat transmission pistons are deflected linearly simultaneously in opposite directions.

Figure 7A:
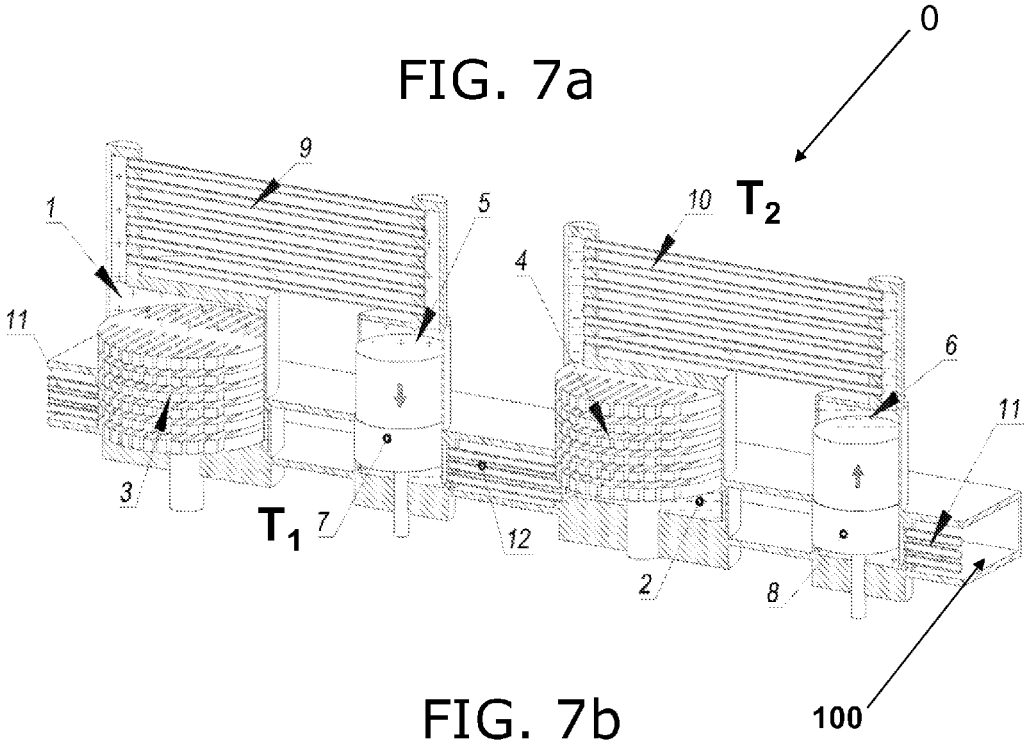
FIGS. 7*a* to 7*d* present an illustration, partially in section, along a circular line D of FIG. 6, wherein the different cycles of the thermal engine are illustrated.
Figure 7B:
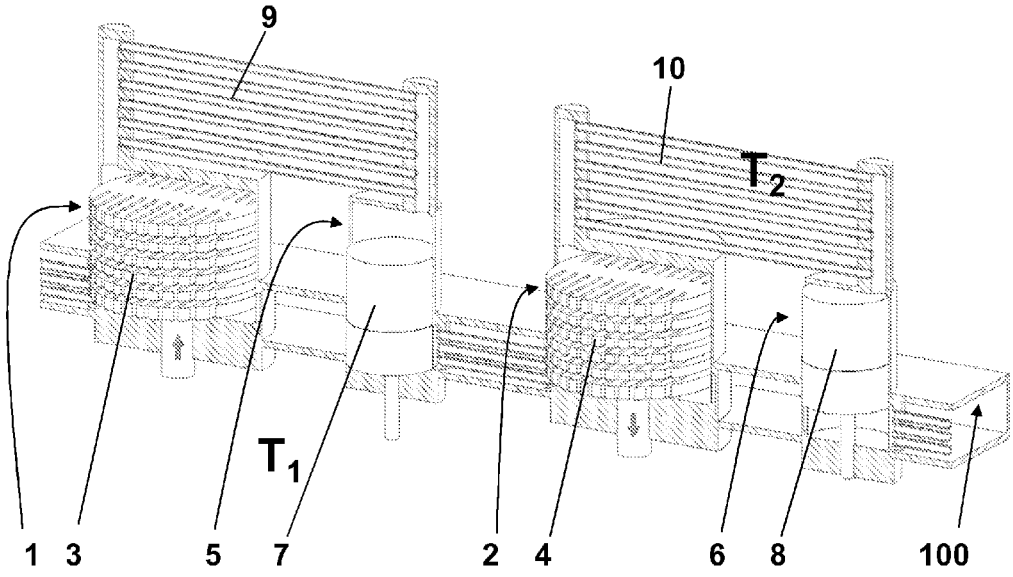
Figure 7C:
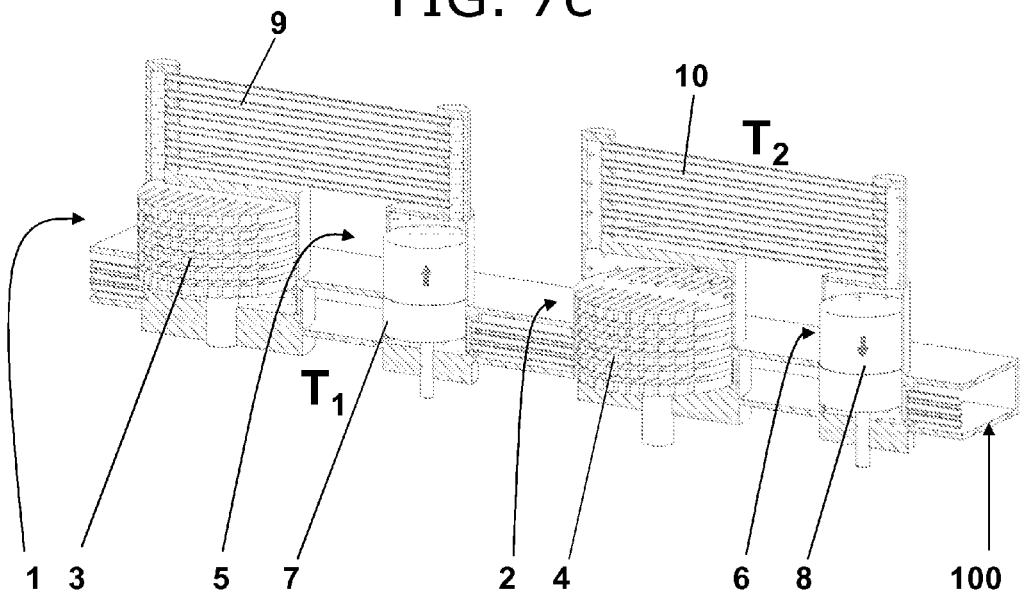
Figure 7D:
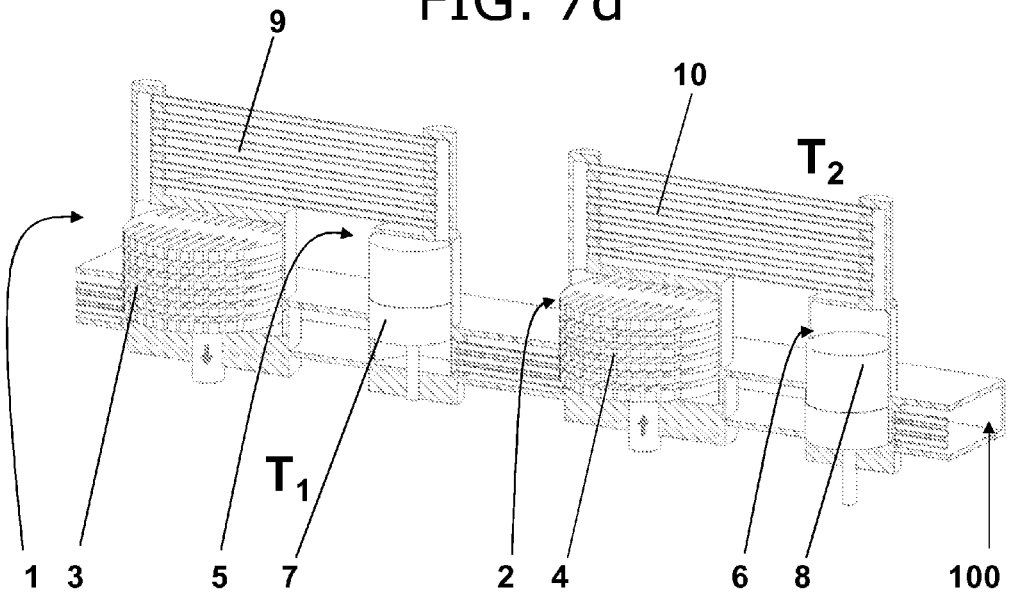

FIGS. 8*a* to 7*d* show a section through all four chambers 1, 2, 5, 6 along the line D, which is illustrated folded into the plane of the paper. The displacement spaces, which are filled with working medium under maximum pressure, are marked with a "+" sign. Correspondingly, the displacement spaces in which the pressure is minimal are marked with a "−" sign.

$1^{st}$ Cycle

FIG. 7*a* shows the movement of the first working piston 7 and of the second working piston 8 during the rotation of the eccentric disc 24 from 0° to 90°. The working medium in the first heat transmission chamber 1, in the first heat exchanger 9, in the upper hot region of the first working chamber 5 and in the lower cold region of the second working chamber 6 is under high pressure. By the segmenting of the first heat transmission piston 3, which was previously heated up, the working medium was able to be additionally heated up. The first heat transmission piston 3 is at the cooled lower stop of the first heat transmission chamber 1, whilst the first working piston 7 is deflected centrally inside the first working chamber 5. By the segmenting of the first heat transmission piston 3, the working medium can flow through the longitudinal slots 13 from the hot side of the heat transmission piston 3 in the direction of the first cooling device 11 into the lower cold region of the second working chamber 6 beneath the second working piston 8. The second segmented heat transmission piston 4 is situated at the start at the upper hot stop of the second heat transmission chamber 2. The working medium can flow under low pressure from the working chamber 6 through the second heat exchanger 10 through the longitudinal slots 13 into the cold region of the second heat transmission chamber 2 and the second cooling device 12 into the cold region of the first working chamber 5.

$2^{nd}$ Cycle

A second cycle follows by the rotation of the wobble disc from 90° to 180°. Owing to the mechanical coupling of the four pistons 3, 4, 7, 8 on the wobble plate 18, the first working piston 7 is drawn downwards up to the cooled stop, whilst the second working piston 8 is pressed upwards up to the heated stop. Owing to the pressure difference, a movement of the first working piston 7 takes place downwards and of the second piston 8 upwards, respectively in the direction of the lower pressure of the working medium. Work is thereby carried out effectively by an expansion of the working medium.

At the end of the first movement, the first working piston 7 is deflected up to the lower cold stop and the second working piston 8 is deflected up to the upper hot stop, wherein an expansion of the working medium takes place.

By a further rotation of the wobble plate 18, the first and second heat transmission pistons 3, 4, lying opposite each other, are displaced linearly in a mirror-inverted manner. Whilst the first heat transmission piston 3 is in an upward movement in the direction of the first heat exchanger 9, the second heat transmission piston 4 moves in the direction of the cold lower stop of the second heat transmission chamber 2.

Heated working medium, which emits its thermal energy to the heat transmission piston 3, flows through the longitudinal slots 13 of the first heat transmission piston 3, whereby the working medium cools down. By the large area of the heat transmission piston 3, such an amount of heat is withdrawn from the working medium that the pressure in the first heat transmission chamber 1 decreases greatly.

By the movement of the second heat transmission piston 4, heated in Cycle 1, in the direction of the cooled stop of the first heat transmission chamber 2, cold working medium flows through the segmented heat transmission piston 4. Thermal energy is emitted to the working medium, whereby the working medium is already pre-heated with the flow in the direction of the second heat exchanger 10. By the emission of the thermal energy through the second heat transmission piston 4, the pressure in the second heat transmission chamber 2 increases.

$3^{rd}$ Cycle

As is clear in FIG. 7*c*, a low pressure prevails in the first heat transmission chamber 1, in the second heat exchanger 9 and in the upper region of the first working chamber 5. A high pressure of the working medium prevails accordingly in the second heat transmission chamber 2, in the second heat exchanger 10 and in the second working chamber 6. Through these pressure differences, the first working piston is deflected in the direction of the first heat exchanger 9 and the second working piston is deflected in the direction of the second heat exchanger 10, with mechanical work being again carried out.

$4^{th}$ Cycle

A further deflection of the wobble disc 18 from 270° to 360° leads the first heat transmission piston 3 in the direction of the cold stop and the second heat transmission piston 4 in the direction of the hot stop, with the first working piston 7 being situated at the hot stop and the second working piston 8 at the cold stop.

The heat transmission pistons 3, 4 are able to receive a large amount of thermal energy and to emit to the working medium during the process, whereby a pre-cooling or respectively a pre-heating of the working medium takes place. The amount of thermal energy which is able to be received by the heat transmission pistons 3, 4 is distinctly greater here than the work carried out in the thermodynamic cyclic process.

Due to the heat transmission pistons 3, 4 constructed in a segmented manner, more thermal energy is emitted to the working medium than in the known conventional Stirling cyclic process. Thereby, more mechanical work can be carried out and therefore a higher degree of efficiency can be achieved.

Figure 8:
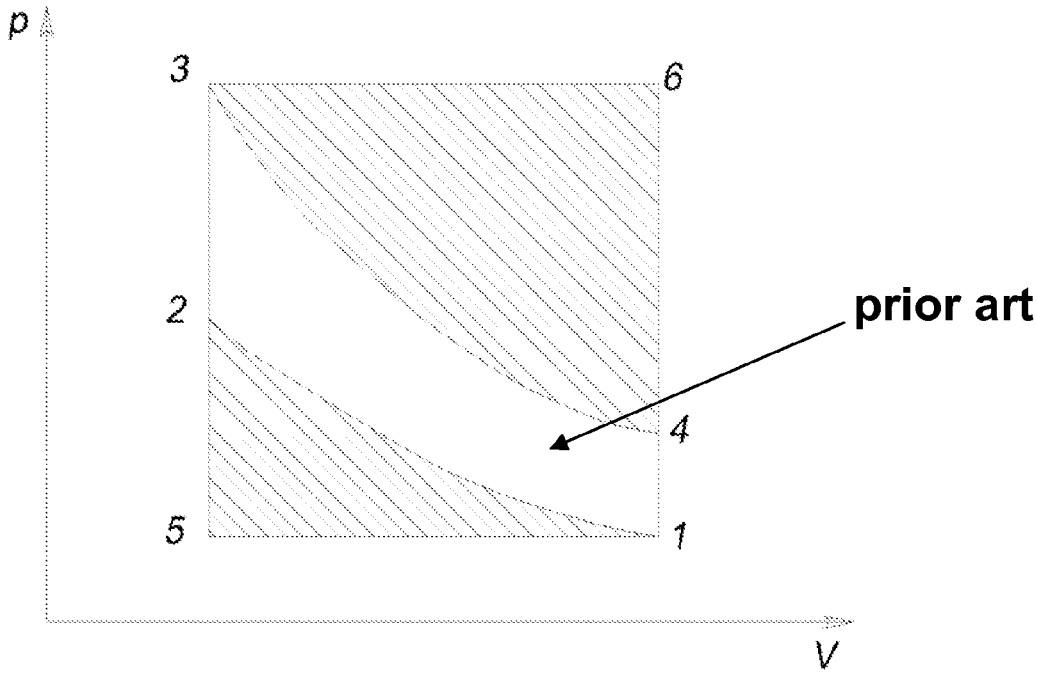
FIG. 8 shows a p-V diagram of an ideal clockwise Stirling process, and of an ideal pseudo-cyclic process, able to be achieved under ideal circumstances, according to 1-5-3-6.

FIG. 8 shows a p-V diagram of the known ideal clockwise Stirling process, wherein

3→4 an isothermal expansion with the delivery of heat

4→1 an isochoric cooling

1→2 an isothermal compression with supplied volume change and

2→3 an isochoric heating is a closed cyclic process and the convertible mechanical work represents the area under the cycles.

With the device presented here, a modified process can be carried out, wherein an ideal pseudo-cyclic process according to 1-5-3-6 is possible. In the ideal case, this process describes a rectangle, wherein with a constant pressure p1 a volume reduction is run through at the temperature T1 (1→5). Then at a constant volume V1 a compression is carried out from p1 to p2 (5→3). At pressure p2 a volume increase takes place from V1 to V2 (3→6). Before an isochoric cooling with simultaneous pressure reduction from p2 to p1 takes place (6→1). Here, also, the mechanically convertible work is described by the area beneath the cycle, wherein the hatched area indicates the additional proportion of work. It becomes clear from FIG. 8 that the thermal engine 0 according to the invention leads to a higher degree of efficiency which is able to be reached, wherein the process parameters of pressure, temperature and volume change correspond to known Stirling cyclic processes.

So that the thermal engine 0 has minimal vibrations during operation and to balance out a dynamic unbalance owing to the rotating eccentric disc 24, the rotation axis of which does not coincide with one of the stable main axes of inertia, the eccentric disc is provided unsymmetrically with a thickening. This thickening can be clearly seen in FIG. 4 and forms a balancing weight.

The pressure occurring in the first working chamber 5 and in the second working chamber 6 during the compression of the working medium is approximately 6 to 7 MPa. Owing to the use of air as working medium, the requirements for sealing the total interior of the thermal engine 0 are not particularly high. High-grade steel is used for the chambers 1, 2, 5, 6 and pistons 3, 4, 7, 8, with soldered joints being connected with a solder containing copper and magnesium.

The hollow embodiment of the first and second working piston 7, 8 is advantageous. The necessary stability is given and owing to the minimized weight an optimum force transmission is possible. In order to protect the working pistons 7, 8 from the heat which occurs, in further embodiments mineral fibres, in particular basalt fibres, are introduced into the interior of the working pistons 7, 8. The basalt fibres are present in amorphous form and in addition to a protective effect against heat have a mechanically strengthening effect.

On the upper side of the base flange 100, facing the guide link 101, piston guides are formed through which the piston pins, stabilized by a bore, are moved alternately in a guided manner linearly into the corresponding chambers. The linear movement of the pistons 3, 4, 7, 8 is converted into rotary movement of the wobble plate 18, of the eccentric disc 24 and finally of the flywheel 21. By the type of coupling shown here, the pistons 3, 4, 7, 8 can, however, also be deflected by rotation of the flywheel 21.

In further embodiments, more than two pairs of heat transmission chamber and associated working chamber, connected via a heat exchanger, can form the thermal engine 0 according to the invention. Accordingly, further heat transmission pistons and working pistons would have to be provided, which are mounted movably in the additional chambers. The mechanism for uncoupling the linear piston movement and conversion into a rotary movement to drive the flywheel 21 must be coordinated respectively with the number of pistons used.

In the development of the first heat transmission piston 3, embodied in a segmented manner, this first heat transmission piston 3 was incorporated into known commercially available Stirling engines and thermal engines according to a Stirling engine and was thereby experimented. Known thermal engines with only a first heat transmission chamber 1 were used here. The degree of efficiency of such thermal engines is not particularly high with the use of pistons according to the prior art. After the incorporation of the one segmented heat transmission piston 3 into the one heat transmission chamber 1 and the use of air as working medium, good results were able to be achieved, with a similarly high degree of efficiency as in the standard operation, for example with helium gas.

It was thereby shown that a use of air as working medium by the use of a segmented first heat transmission piston 3 is able to be carried out successfully in known Stirling engines. The great problems which occur in known Stirling engines owing to the use of helium can thereby be circumvented by a use of the first segmented heat transmission piston 3 and the use of air. The initially used heat transmission pistons 3 already had, as described above, a plurality of longitudinal slots 13 and/or transverse slots 14.

To transfer the linear translatory movement of the pistons 3, 4, 7, 8 into a rotary movement, the crank drive 40 can be used as is described below. In addition to the drive of a flywheel 21, the drive of a crankshaft 400 is therefore also possible. The crank drive 40 allows good power transmission in operation of the thermal engine 0, wherein according to the construction a simple stringing together of several thermal engines 0 or respectively of several pairs of working pistons 7, 8 and heat transmission pistons 3, 4 is possible.

The crank drive 40 comprises the crankshaft 400, which is arranged in a crank drive housing 41 rotatably in a fixed manner on at least one crankshaft bearing 401. Connected with the crankshaft 400, via a crank pin 4010, is at least one lifting element 403, which is mounted eccentrically to the rotation axis of the crankshaft 400 on the crankshaft 400 and can thereby set the crankshaft 400 into a rotary movement. The lifting element 403 has a cross-beam 4031, at the ends of which respectively a working piston 7 and a heat transmission piston 3 are arranged. By means of joints 405, two double joint rods 404 are fastened so as to be rotatably movable over roller bearings 407 at the ends of the cross-beam 4031. On the side of the lifting element 403 facing away from the cross-beam 4031, the pistons 3, 4, 7, 8 are again mounted by roller bearings by means of fork couplings 406 so as to be movable in the double joint rods 404.

A pivoted lever 402 is fastened pivotably respectively in a pivoted lever bearing 4022 on the crank drive housing 41 and on the side projecting into the crank drive housing 41 is connected with the lifting element 403 movably by a pivoted rod 4021, preferably mounted by roller bearings.

Figure 9A:
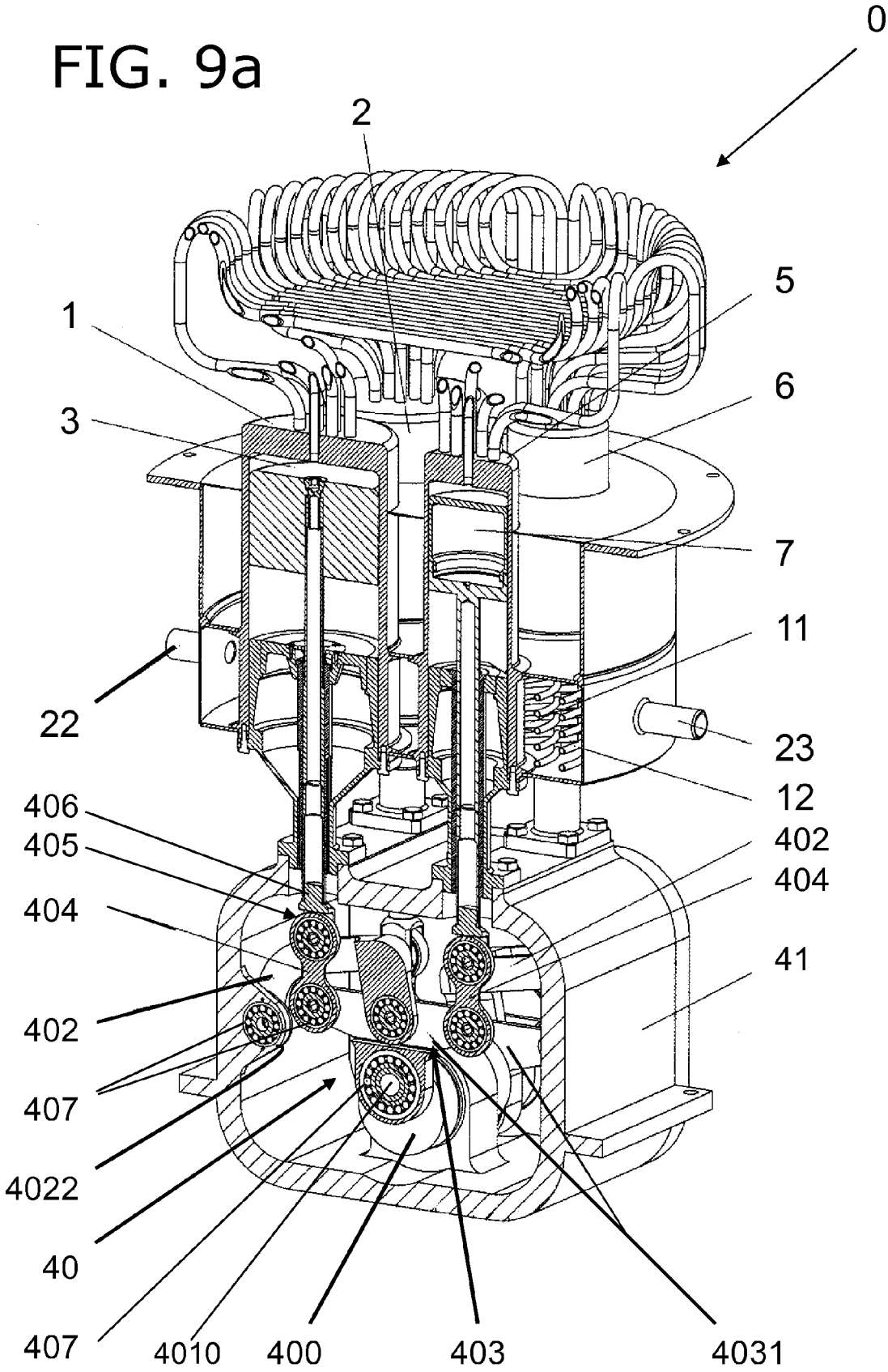
FIG. 9*a* shows a perspective view, partially in section, of a thermal engine with crank drive inside a crank drive housing, whilst
Figure 9B:
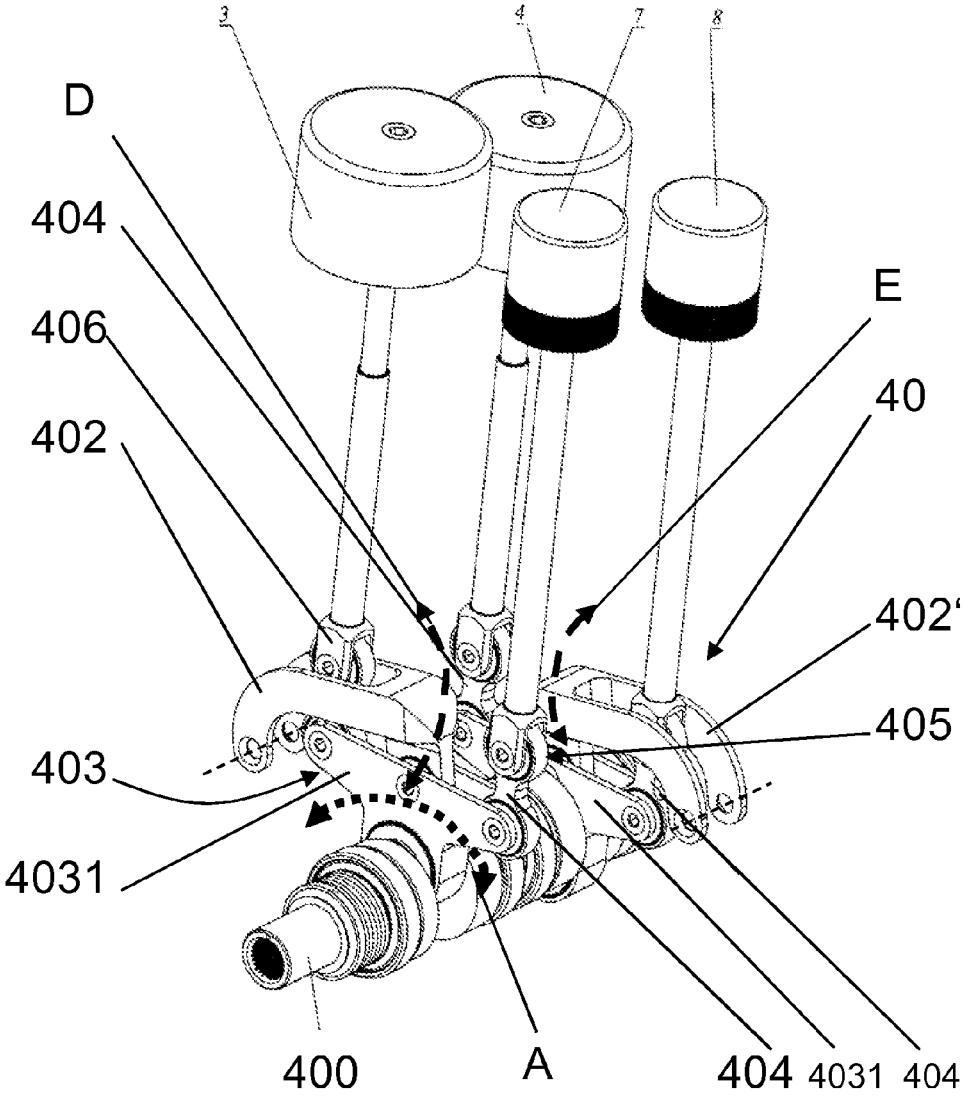
FIG. 9*b* shows a perspective view of the crank drive with coupled pistons.

In the operation of the thermal engine and the periodic deflection of the pistons 3, 4, 7, 8, the lifting element 403 is deviated according to the arrow marking A in FIG. 9*b*, according to the deflection of the adjacently suspended pistons and owing to the eccentric fastening on the crank pin 4010 of the crankshaft 400 is guided up and down in the direction perpendicularly to the crankshaft axis. By selection of the distance of the suspension of the piston 7 and of the piston 3, an optimum power transmission can be achieved onto the crankshaft 400 owing to the phase displacement of the pistons. The pistons 3, 7 and the pistons 4, 8 are respectively fastened on different crank pins on the crankshaft 400, so that a necessary phase displacement of the piston pairs with respect to each other is able to be achieved.

By the coupling of the pivoted rod 4021 on the lifting element 403, the pivoted lever 402 is entrained with the up-and-down movement and is deviated accordingly about the pivoted lever bearing 4022. The pivoted lever 402 is embodied here in forked form, wherein respectively one of the pistons or respectively piston rods is mounted so as to be able to be guided through the forked region of the pivoted lever 402. The phase displacement of the movable pistons can also be set by the arrangement of the pivoted levers 402 on the crank drive housing 41. The pivoting movement of the front pivoted lever 402 is defined by the arrow marking D and the pivoting movement of the rear pivoted lever 402' is defined by the arrow marking E.

Figure 10A:
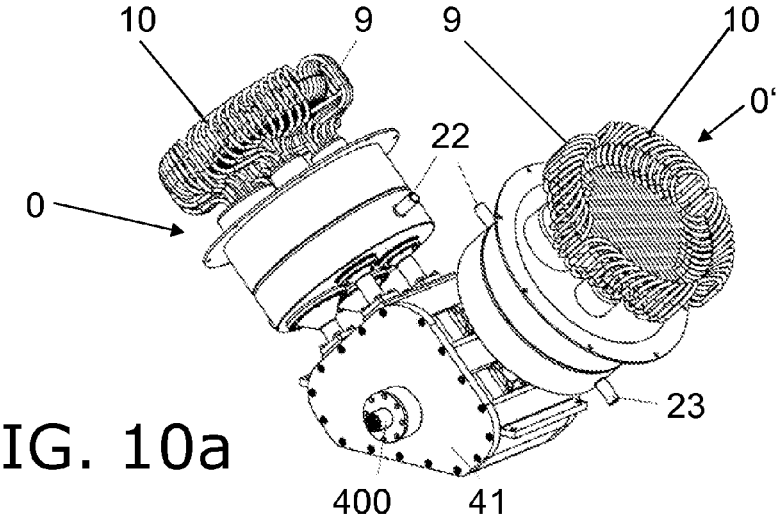
FIG. 10*a* shows a perspective view of two thermal engines, coupled to a crankshaft, whilst
Figure 10B:
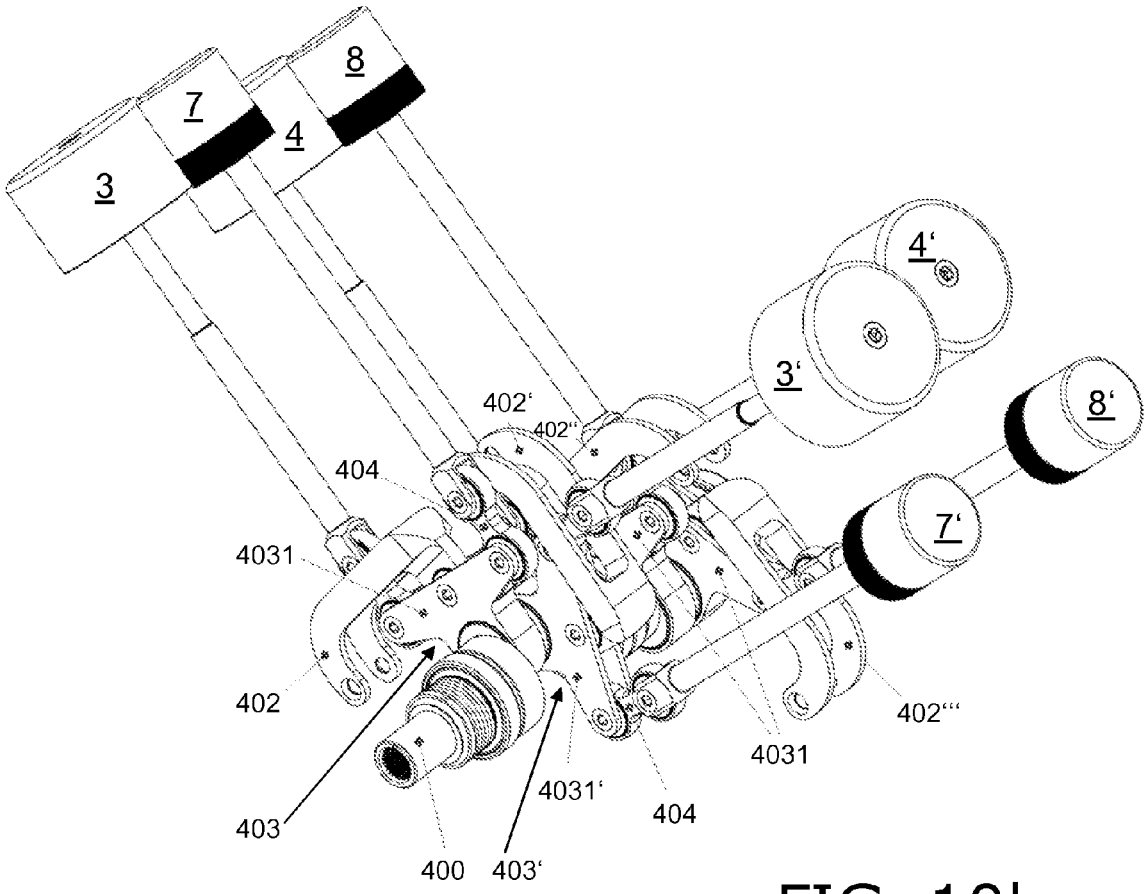
FIG. 10*b* shows a perspective view of the coupled pistons according to FIG. 10*a* without a crank drive housing.

According to the construction, several thermal engines 0 are able to be coupled linearly via the crank drive 40 on a crankshaft 400, so that as is known in FIG. 10*a* for example two thermal engines 0 can be coupled in a crank drive housing 41, as known from V engines. In order to bring about this coupling as far as possible on the smallest space, respectively pistons 3, 7 of a first thermal engine 0 and pistons 3', 7' of a second thermal engine 0 are differently aligned adjacently via two adjacent cross-beams 4031 and 4031', but arranged at the same crank pin 4010. Likewise, the pistons 4, 8 and 4', 8' are arranged directly adjacently, indirectly on the crankshaft 400. So that an optimum power transmission can also be achieved here, the lifting elements 403 must be arranged on the crankshaft 400 corresponding to the prevailing phase displacement of the piston movement. Here, also, the lifting elements 403 respectively carry out a combined pivot movement and a movement perpendicularly to the crankshaft axis.

Figure 11:
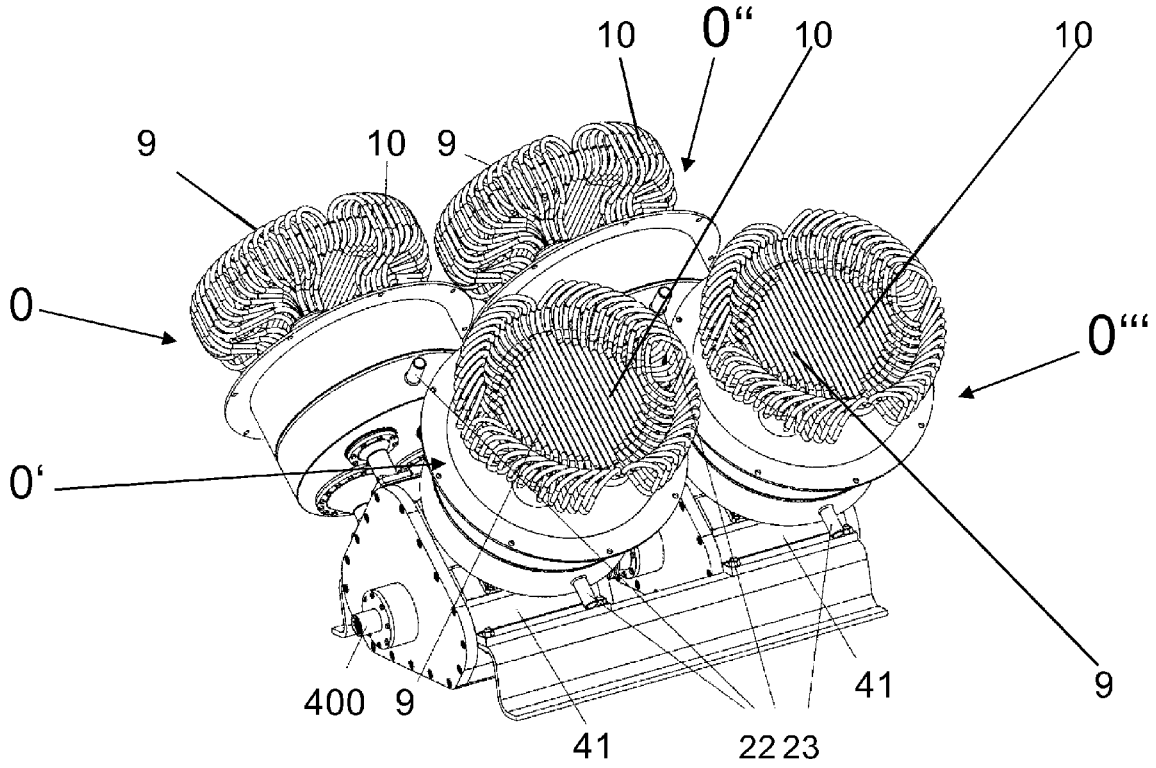
FIG. 11 shows a perspective view of a total of four coupled thermal engines.

As shown in FIG. 11, a modular arrangement of several thermal engines 0, 0', 0'', 0''' can be simply carried out on a crankshaft 400, wherein the crank drives 40 respectively of two thermal engines 0, 0' and 0'', 0''' are arranged in a crank drive housing 41 respectively.

LIST OF REFERENCE NUMBERS

0 Thermal engine
1 First heat transmission chamber
  3 first heat transmission piston (slotted)
  Length and diameter greater than first working piston
2 Second heat transmission chamber
  4 second heat transmission piston (slotted)
  Length and diameter greater than second working piston
5 First working chamber
  7 first working piston
6 Second working chamber
  8 second working piston
9 First heat exchanger/heating unit
10 Second heat exchanger/heating unit
11 First cooling device
12 Second cooling device
13 Longitudinal slots
14 Transverse slots
15 Upper piston position (vicinity heating unit)
16 Lower piston (vicinity cooling device)
17 Shaft
  170 Shaft longitudinal axis
18 Wobble plate
19 Cardan joint
20 Joint fastening
21 Flywheel
22 Coolant inlet
23 Coolant outlet
24 Eccentric disc
  240 eccentric bore
  241 shaft bearing
  242 pin
25 Coupling rod
100 Base flange
101 Guide link
  1010 Ball bearing
102 Bearing
103 Drive shaft
L Longitudinal axis
B Central connecting line between first and second working chamber
C Central connecting line between first and second working chamber
α Angle between B and C
  40 Crank drive
    400 Crankshaft
      4010 Crank pin
    401 Crankshaft bearing (rigid)
    402 Pivoted lever forked (one per pair)
      4021 Pivoted rod
      4022 Pivoted lever bearing
    403 Lifting element
      4031 Cross-beam
    404 Double joint rod
    405 Joint
    406 Fork coupling
    407 Roller bearing
41 Crank drive housing
A Pivot movement direction of the cross-beam 4031
D Pivot movement of the front pivoted lever
E Pivot movement of the rear pivoted lever

I Claim:

1. A thermal engine with a driven flywheel or a crankshaft with a closed total interior, which is able to be closed in a pressure-tight manner, comprising:

a first working chamber with a linearly movable first working piston having a first working piston head;

a first heat transmission chamber with a linearly movable first heat transmission piston having a first heat transmission piston head, wherein the first working piston and the first heat transmission piston are coupled mechanically with each other;

a first heat exchanger that connects the first working chamber with the first heat transmission chamber;

a second working chamber with a linearly moveable second working piston having a second working piston head;

a second heat transmission chamber with a linearly moveable second heat transmission piston having a second heat transmission piston head, whreein the second working piston and the second heat transmission piston are coupled mechanically with each other;

a second heat exchanger that connects the second working chamber with the second heat transmission chamber, a first cooling device and a second cooling device, wherein the first cooling device is arranged between the second working chamber and the first heat transmission chamber and the second cooling device is arranged between the first working chamber and the second heat transmission chamber;

a wobble plate that mechanically couples the first and second heat working pistons ant the first and second transmission pistons;

wherein the first heat transmission piston head and the second heat transmission piston head are each embodied in a segmented and/or slotted manner, whereby the first heat transmission piston head and the second heat transmission piston head have an enlarged contact surface with respect to the first working piston head and the second working piston head, respectively, and whereby thermal energy is able to be emitted from the first heat transmission piston and the second heat transmission piston to a surrounding working medium.

2. The thermal engine of claim 1, wherein the first heat transmission piston head has a plurality of longitudinal slots, whereby a through-flow of the working medium is able to be achieved through the first heat transmission piston head out of the region of the first heat exchanger in the direction of a piston pin.

3. The thermal engine of claim 1, wherein the first heat transmission piston head has a plurality of traverse slots, which make heat conduction difficult through the first heat transmission piston between a heated part and a cooled part of the first heat transmission chamber.

4. The thermal engine of claim 1, wherein the cross-sectional areas of the first heat transmission chamber and of the first heat transmission piston are greater than the cross-sectional areas of the first working chamber and the first working piston.

5. The thermal engine of claim 1, wherein the first and second working chambers, the first and second heat transmission chambers and the first and second cooling devices are arranged in a base flange and the first and second cooling devices inside the base flange are in thermal contact with a coolant.

6. The thermal engine of claim 1, wherein an angle $\alpha$ in the range of 90° to 140° is spanned between a central connecting line, which runs along the centers of the first and second hat transmission chambers and through the longitudinal axis and a further connecting line, which runs along the centers of the first and second working chambers and through the longitudinal axis.

7. The thermal engine of claim 1, wherein the first heat transmission piston and the first working piston are fastened on two opposite sides of a first lifting element, wherein by arrangement of the lifting element on a crank pin, the crankshaft is able to be set in rotation.

8. The thermal engine of claim 7, wherein the lifting element is movable up and down perpendicularly to the crankshaft axis by means of pivoted levers pivotally about a pivoted lever bearing on a housing for the crank drive.

9. The thermal engine of claim 1, wherein the first and second heat transmission pistons have segmented piston heads.

10. The thermal engine of claim 8, wherein the second heat transmission piston and second working piston are fastened on two opposite sides of a second lifting element, and wherein the first and second lifting elements are arranged in a phase-shifted manner pivotally by the four pistons on the crankshaft.

* * * * *

UNITED STATES PATENT AND TRADEMARK OFFICE

CERTIFICATE OF CORRECTION

PATENT NO. : 8,418,454 B2
APPLICATION NO. : 12/813397
DATED : April 16, 2013
INVENTOR(S) : Alexander Samarin It is certified that error appears in the above-identified patent and that said Letters Patent is hereby corrected as shown below:

In the Claims:

| Col. No. | Line(s) | Edits |
|---|---|---|
| 11 | 22 | Replace "pistons ant the first" with --pistons and the first-- |

Signed and Sealed this
Ninth Day of July, 2013

Teresa Stanek Rea
*Acting Director of the United States Patent and Trademark Office*